US009923285B2

(12) United States Patent
Juillet et al.

(10) Patent No.: US 9,923,285 B2
(45) Date of Patent: Mar. 20, 2018

(54) METHOD AND RELATED DEVICE FOR CONNECTING TO A METALLIC SHIELD OF A CABLE

(71) Applicant: Richards Manufacturing Company, a New Jersey Limited Partnership, Irvington, NJ (US)

(72) Inventors: Christopher A. Juillet, Hoboken, NJ (US); Jeff Madden, Bernardsville, NJ (US); Glenn J. Luzzi, Mt. Bethel, PA (US)

(73) Assignee: Richards Manufacturing Company, a New Jersey Limited Partnership, Irvington, NJ (US)

( * ) Notice: Subject to any disclaimer, the term of this patent is extended or adjusted under 35 U.S.C. 154(b) by 0 days.

(21) Appl. No.: 15/187,019

(22) Filed: Jun. 20, 2016

(65) Prior Publication Data

US 2017/0365937 A1 Dec. 21, 2017

(51) Int. Cl.

| | |
|---|---|
| ***H01R 9/05*** | (2006.01) |
| ***H01R 4/14*** | (2006.01) |
| ***H01R 4/48*** | (2006.01) |
| ***H01R 4/02*** | (2006.01) |
| ***H01R 4/72*** | (2006.01) |
| ***H01R 43/02*** | (2006.01) |

(52) U.S. Cl.
CPC ..... *H01R 4/14* (2013.01); *H01R 4/02* (2013.01); *H01R 4/48* (2013.01); *H01R 4/72* (2013.01); *H01R 43/02* (2013.01)

(58) Field of Classification Search
CPC ..... H01R 9/0503
USPC ..... 174/75 C, 78, 88 C
See application file for complete search history.

(56) References Cited

U.S. PATENT DOCUMENTS

| | | | | | |
|---|---|---|---|---|---|
| 3,376,540 | A * | 4/1968 | Turban | H01R 13/501 | 439/595 |
| 3,593,002 | A * | 7/1971 | Hebert | H05B 3/56 | 174/78 |
| 3,673,311 | A * | 6/1972 | Misare | H02G 15/184 | 174/73.1 |
| 4,032,205 | A * | 6/1977 | Taj | H02G 15/068 | 174/78 |
| 4,164,621 | A * | 8/1979 | Silva | H02G 15/105 | 156/49 |

(Continued)

*Primary Examiner* — Chau N Nguyen
(74) *Attorney, Agent, or Firm* — Stroock & Stroock & Lavan LLP

(57) ABSTRACT

A device for electrically connecting a cable metallic shield to another electrical element includes a neutral connection portion and an extended connecting member. The neutral connection portion is a flexible contact strip for electrically connecting to the metallic shield of the cable. The extended connecting member connects to the neutral connection portion and is used to electrically connect to another electrical element. The extended connecting member has a plurality of electrical members disposed over the contact strip. A clamping device biases the contact strip against the metallic shield of the cable. In use, an environmental jacket from the electrical cable is removed to expose the metallic shield of the cable. The contact strip is wrapped around the exposed metallic shield, and the clamping device is then connected to the contact strip. Another end of the extended connecting member is then used to connect to the other electrical element.

28 Claims, 13 Drawing Sheets

(56) References Cited

U.S. PATENT DOCUMENTS

| | | | | | |
|---|---|---|---|---|---|
| 4,414,969 | A * | 11/1983 | Heyman | A61F 5/3761 | 128/878 |
| 4,565,417 | A * | 1/1986 | Dussel | H01R 13/52 | 439/108 |
| 5,028,742 | A * | 7/1991 | Redman | H01R 9/05 | 174/78 |
| 6,777,616 | B2 * | 8/2004 | Beele | H02G 3/22 | 174/140 R |

* cited by examiner

METHOD AND RELATED DEVICE FOR CONNECTING TO A METALLIC SHIELD OF A CABLE

BACKGROUND OF THE INVENTION

1. Field of the Invention

The present invention generally relates to cable shielding. In particular, various embodiments of the invention are directed to methods and devices for electrically connecting to the metallic shield of a cable.

2. Description of the Related Art

Power cables typically used in utility systems from 4 kV to 35 kV are comprised of several elements including a conductor that carries the electrical power, insulation around the conductor, a semiconductive layer around the insulation, a metallic shield around the semiconductive layer and finally an overall environmental jacket. Whenever such power cables are spliced or terminated, each of the cable elements must be properly reconstructed at the splice or terminating device. In particular, devices are used to reconstruct or restore the cable metallic shield. Such devices are required to ensure any steady-state and short-circuit currents can be adequately carried from one cable to the second cable, or from a cable to an earth ground connection, as required. In addition, these devices must perform adequately for the life of the cable on which they are installed, which is typically considered to be about 40 years.

Currently available devices suffer from a number of shortfalls, including:

- complex installation;
- difficulty in contacting the cable metallic shield uniformly around the circumference of the cable;
- inability to meet the design ratings of the cable;
- inability to meet the design ratings of the cable after the cable is operating at its designed steady-state current/temperature ratings for its full life;
- inconsistent field assembly;
- inconsistent contact resistance between the cable metallic shield and the device;
- changing contact resistance between the cable metallic shield and the device as the cable heats and cools; and
- difficulty in deploying constant force springs, including ergonomic concerns relating to personal injury.

Additionally, conventional methods of ensuring adequate contact resistance tend to deform the cable polymeric layers. Further, since cable metallic shields come in a variety of designs, including wire, tape, and longitudinally corrugated shield, as well as a variety of ampacity ratings, such as equal to the conductor, ⅓ of the conductor, 1/12 of the conductor etc., it is difficult to have a single device which is adequate for all designs.

It is therefore desirable to provide an improved device for the reconstruction or restoration of the metallic shield of a cable.

SUMMARY OF PREFERRED EMBODIMENTS

In one aspect, a device for electrically connecting a metallic shield of a cable to another electrical element includes a neutral connection portion for electrically connecting to the metallic shield of the cable and a conductor portion having a first end electrically connected to the neutral connection portion and a second end configured to connect to another electrical element. The conductor portion comprises a plurality of electrical members. The neutral connection portion comprises a flexible, electrically-conductive contact strip. The plurality of electrical members are electrically connected to the electrically-conductive contact strip. The conductor portion also includes a clamping device for biasing the electrically-conductive contact strip against the metallic shield of the cable. The electrically-conductive contact strip is configured to be wrapped around a circumference of the metallic shield of the cable. Preferably, the electrically-conductive contact strip has a length that is at least as long as the circumference of the metallic shield of the cable. In the preferred embodiment, the clamping device is a constant force spring, which can be, for example, mechanically connected to an end of the electrically-conductive contact strip. In certain embodiments, the constant force spring can be equipped with a loop (e.g., circular or U-shaped) device for easy deployment.

In certain embodiments, the plurality of electrical members extend along a top surface of the electrically-conductive contact strip, and a bottom surface of the electrically-conductive contact strip directly contacts the metallic shield of the cable. The electrical members are preferably substantially evenly spaced over at least a portion, and more preferably over substantially the entire length, of the electrically-conductive contact strip.

In some embodiments, the conductor portion further comprises a cover, with the plurality of electrical members extending from the cover. The cover is preferably configured to prevent ingress of water into the neutral connection portion.

In some embodiments, the second end of the conductor portion comprises another neutral connection portion, while in other embodiments the second end comprises a universal connection port.

In another aspect, a method for electrically connecting a metallic shield of a cable to another electrical element includes removing an environmental jacket from the electrical cable to expose the metallic shield of the electrical cable. An electrically-conductive contact strip is wrapped around at least a portion, and preferably the entirety, of the circumference of the exposed metallic shield. The electrically-conductive contact strip is electrically connected to a first end of a conductor portion. A clamping device is connected to the electrically-conductive contact strip to bias the electrically-conductive contact strip against the metallic shield. A second end of the conductor portion is electrically connected to another electrical element.

BRIEF DESCRIPTION OF THE DRAWINGS

The various aspects and embodiments disclosed herein will be better understood when read in conjunction with the appended drawings, wherein like reference numerals refer to like components. For the purposes of illustrating aspects of the present application, there are shown in the drawings certain preferred embodiments. It should be understood, however, that the application is not limited to the precise arrangement, structures, features, embodiments, aspects, and devices shown, and the arrangements, structures, features, embodiments, aspects and devices shown may be used singularly or in combination with other arrangements, structures, features, embodiments, aspects and devices. The drawings are not necessarily drawn to scale and are not in any way intended to limit the scope of this invention, but are merely presented to clarify illustrated embodiments of the invention. In these drawings.

DETAILED DESCRIPTION OF THE PREFERRED EMBODIMENTS

Figure 1:
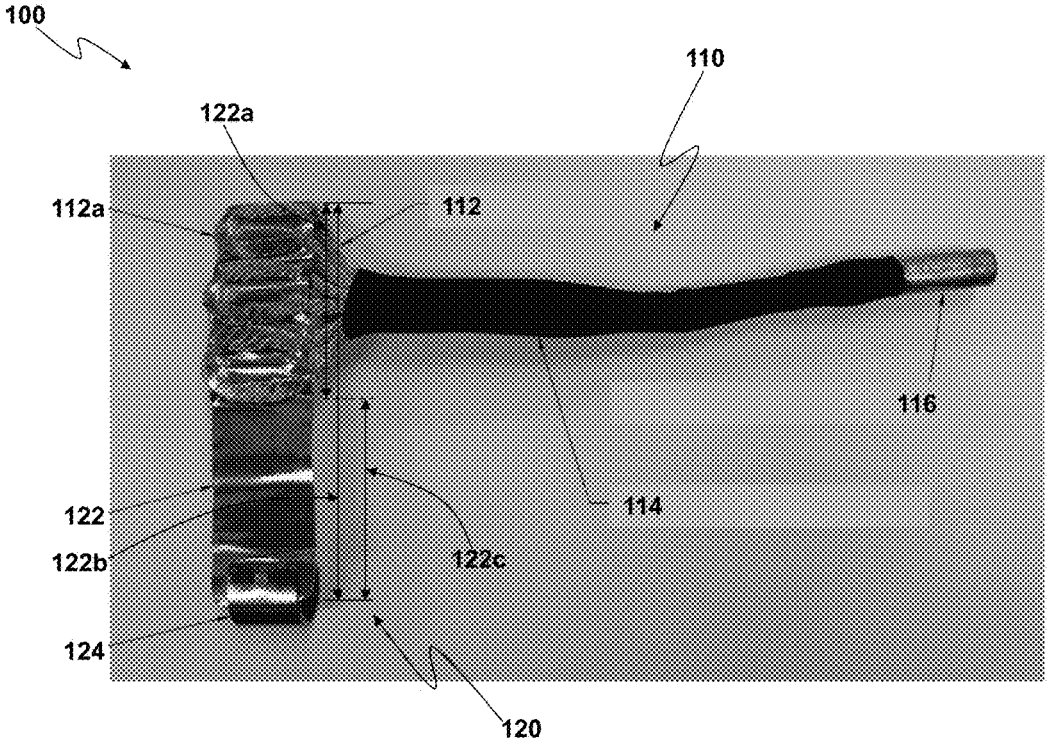
FIG. 1 illustrates an embodiment connector.

FIG. 1 shows an embodiment connector 100 which may be used, for example, to reconstruct or restore a metallic shield of an electrical cable, such as by electrically connecting the metallic shield of the cable to another electrical component e.g., interfaces to a ground connection or to the metallic shield of yet another cable. Connector 100 includes an extended connecting member 110 and a neutral connection portion 120. Extended connecting member 110 is used to electrically connect neutral connection portion 120 to another electrical element 116, such as another neutral connection portion 120, or a universal connection port, which can be, for example, a connector, a ferrule, a compression connector, a flat spade, a bolted connection, or a "T" tap to allow another conductor to be connected. Neutral connection portion 120 is used to electrically connect to the metal shielding of an electrical cable.

Extended connecting member 110 includes a plurality of electrically-conductive members 112 disposed within a cover 114. In some embodiments, cover 114 may be omitted. The members 112 are preferably made from electrically-conductive materials, such as copper, tin-plated copper, a copper alloy (e.g., bronze), aluminum or the like, and may be in the form of, for example, individual strands of conductive material, multi-strand wire, or flexible cable. Extended connecting member 110 preferably has a high electrical conductivity, such as 20% IACS or higher, or more low-conductivity elements 112, to allow conduction of steady state or momentary currents without exceeding 350° C. under typical current-carrying conditions. Cover 114 encloses members 112 and prevents water migration into neutral connection portion 120. Cover 114 may be made from any suitable material that can provide a moisture barrier between the electrically-conductive members 112 and external environment, such as, for example, a heat- or cold-shrinkable moisture seal or tubing, a sealing tape or a dipped coating. Members 112 extend from a first end of cover 114 to electrically connect to neutral connection portion 120 and extend from a second end of cover 114 to electrically connect to other electrical element 116.

Neutral connection portion 120 includes a flexible (e.g., malleable), electrically-conductive contact strip 122 and a clamping device 124. Clamping device 124 may be directly attached to contact strip 122, as shown in FIG. 1, or may be a separate element that is subsequently applied to contact strip 122. Contact strip 122 is used to establish electrical contact with the metal shielding of an electrical cable, while clamping device 124 is used to crimp, clamp or elastically bias contact strip 122 against the metal shielding of the cable, thereby holding contact strip 122 into position around the metal shielding. Clamping device 124 is preferably constructed to hold contact strip 122 against the metal shielding of the cable with a relatively constant pressure while allowing for expansion and contraction of the metal shielding and underlying layers. Contact strip 122 may directly contact the metal shielding of the cable, or may electrically and physically interface through an electrically conductive intermediate material, such as a copper mesh or the like. Contact strip 122 may be made from copper, for example, and preferably has a length at least as long as the circumference of the metal shielding around the electrical cable to ensure sufficient contact with each member of the cable neutral (e.g., metal shielding of the cable). The width of contact strip 122 is preferably equal to or slightly less than the width of the splice region of the exposed cable neutrals to which neutral connection portion 120 is being attached. Contact strip 122 is preferably wide enough to allow for the attachment (e.g., sewing) of members 112 into it and to fit into the width of the exposed cable neutrals. The width of contact strip 122 can also be adjusted to ensure a sufficiently low resistance connection to the cable shield and thereby maintain a connection which will perform within acceptable temperature ranges. Contact strip 122 is also preferably thick enough to resist tearing under conventional stresses of use, while also being thin enough to be flexible under the biasing or clamping of clamping device 124. Other considerations for the thickness of contact strip 122 can include the current density carried through portions of contact strip 122 to adjacent members 112 to ensure the electrical connection will perform within acceptable temperature ranges. As shown in FIG. 1, in preferred embodiments clamping device 124 is a constant force spring. In other embodiments, clamping device 124 can be, for example, a hose clamp, a braided conductive mesh, a rubber band, a tape (e.g., plastic tape or reinforced tape) or a cold-shrink material, such as jacket seal from another component. Clamping device 124 can be pre-attached to contact strip 122 or can be provided as a separate component.

Members 112 extending from the first end of cover 114 are physically and electrically connected to contact strip 122, preferably to the outside surface of contact strip 122. The physical connection of members 112 with contact strip 122 may be direct, as by way of weaving or threading members 112 into contact strip, by pressing members 112 into contact strip 122, or by any other suitable method, or may be indirect, such as through an intermediary, including solder, an electrically conductive (e.g., copper) mesh, or any other suitable intermediate material. Members 112 are preferably fanned out from the first end of cover 114 so that they are substantially evenly spaced over all or a portion of contact strip 122. For example, in some embodiments, the respective distances between immediately adjacent pairs of members 112 are within 25% of the occupying circumference of each other (that is, the variation in distances between adjacent members 112 may be 25% or less). Of course, other variations are possible.

Members 112 are preferably disposed over a sufficiently long portion 122*a* of the total length 122*b* of contact strip 122 such that there is no overlapping of members 112 on contact strip 122. Preferably, the portion 122*a* of contact strip 122 over which members 112 are disposed is sufficiently long that it can go completely around the smallest electrical cable to be serviced by device 100 without the portion 122*a* overlapping itself (although it may be lapped by the remaining portion(s) 122*c* of contact strip 122). Additionally, the total length 122*b* of contact strip 122 is preferably long enough to extend around the entire circumference of the largest electrical cable to be serviced by device 100. Such an arrangement of members 112 and contact strip 122 helps to ensure that the device 100 is as easy to install as possible over the desired range of electrical cables to be serviced.

As previously noted, any suitable method may be employed to physically and electrically connect members 112 to contact strip 122, such as by spot welding, soldering, pressing, etc. By way of the specific embodiment shown in FIG. 1, each member 112 forms a loop 112*a* that extends from the first end of cover 114. This loop 112*a* is threaded through holes or eyelets in contact strip 122, so that a single member 112 exits the first end of cover 114, passes through an eyelet from a bottom surface of contact strip 122, extends across the width of contact strip 122 along the top surface of contact strip 122, serially passes through two eyelets on the opposite second side of contact strip 122 to cross back over the top surface width of contact strip 122, and then returns to the first end of cover 114 via a final eyelet from the bottom surface of contact strip 122. It will be appreciated, however, that other designs are possible to prevent members 112 from physically disconnecting from contact strip 122. By way of example, members 112 may be threaded through eyelets or holes in contact strip 122 but not looped back on themselves; in such an embodiment, members 112 may be soldered or brazed to contact strip 122 or flattened such that contact strip 122 acts as a crimp. By way of yet another embodiment, members 112 can have an end with a dimension larger than the respective hole or eyelet the member 112 is being threaded through, which can be obtained, for example, by flattening the member 112, solder dipping of the member 112 or adding an external piece that is crimped or otherwise connected onto the end of the member 112. V- or U-shaped slots in contact strip 122 may also be used to thread members 112.

Figure 2:
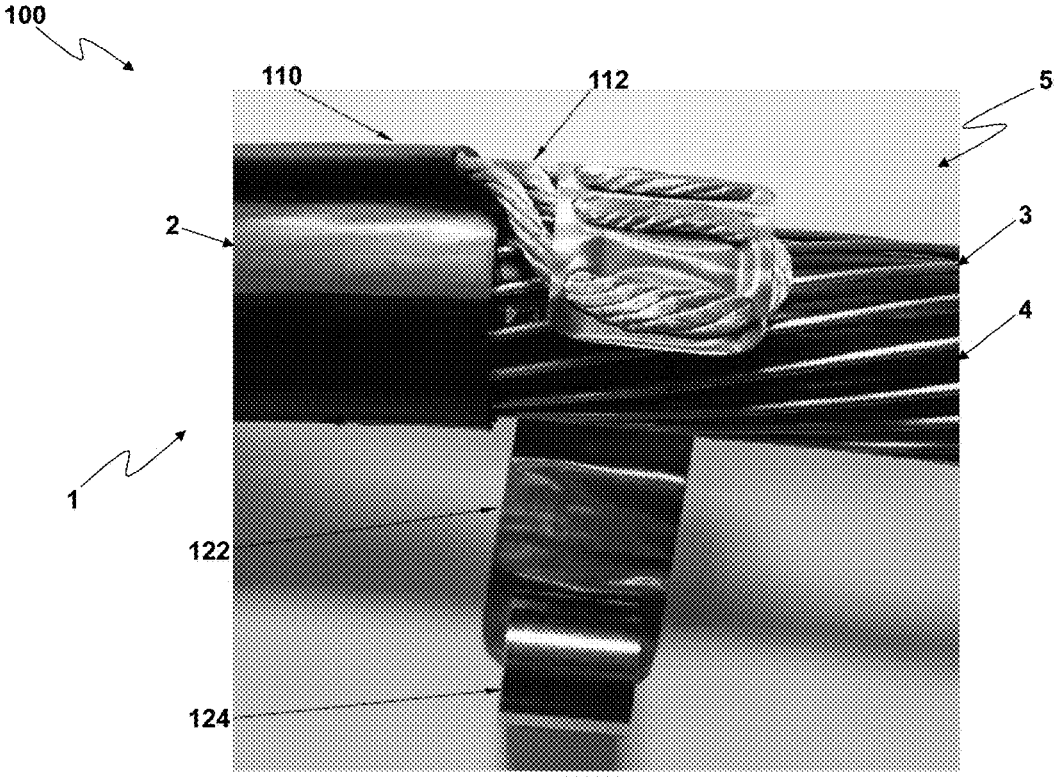
FIG. 2 illustrates the a strap of the connector of FIG. 1 being installed around a metallic cable shield.
Figure 3:
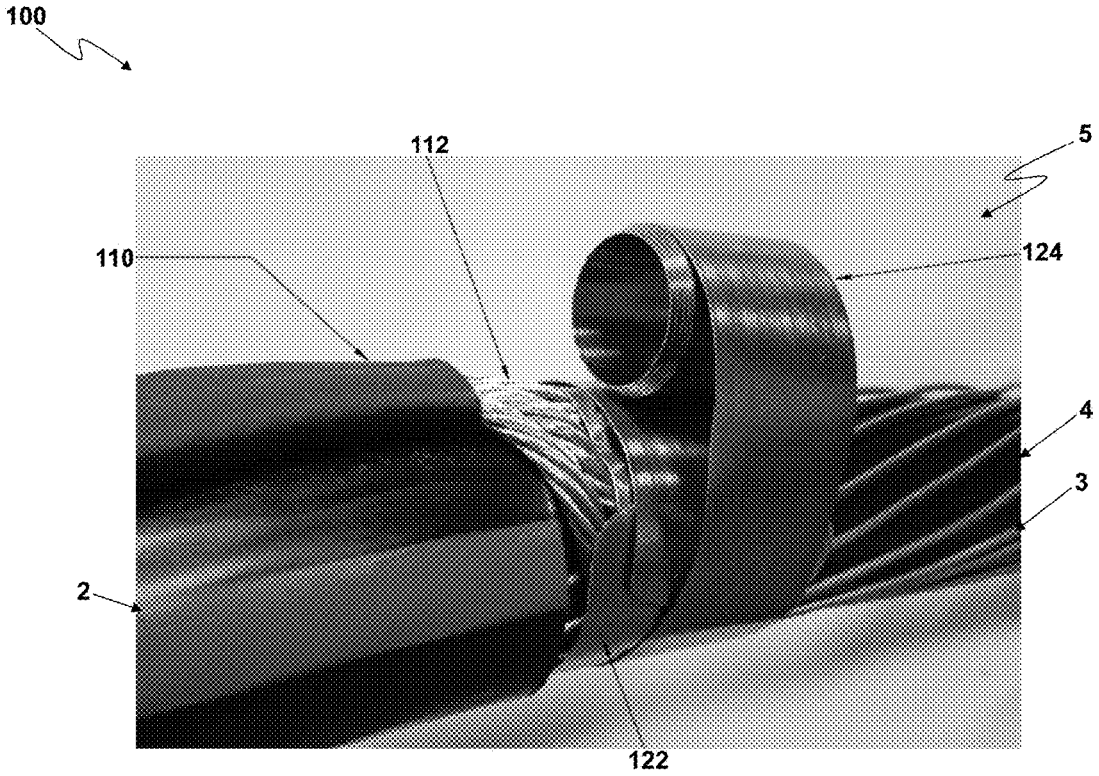
FIG. 3 illustrates a clamping device being installed on the strap shown in FIG. 2.
Figure 4:
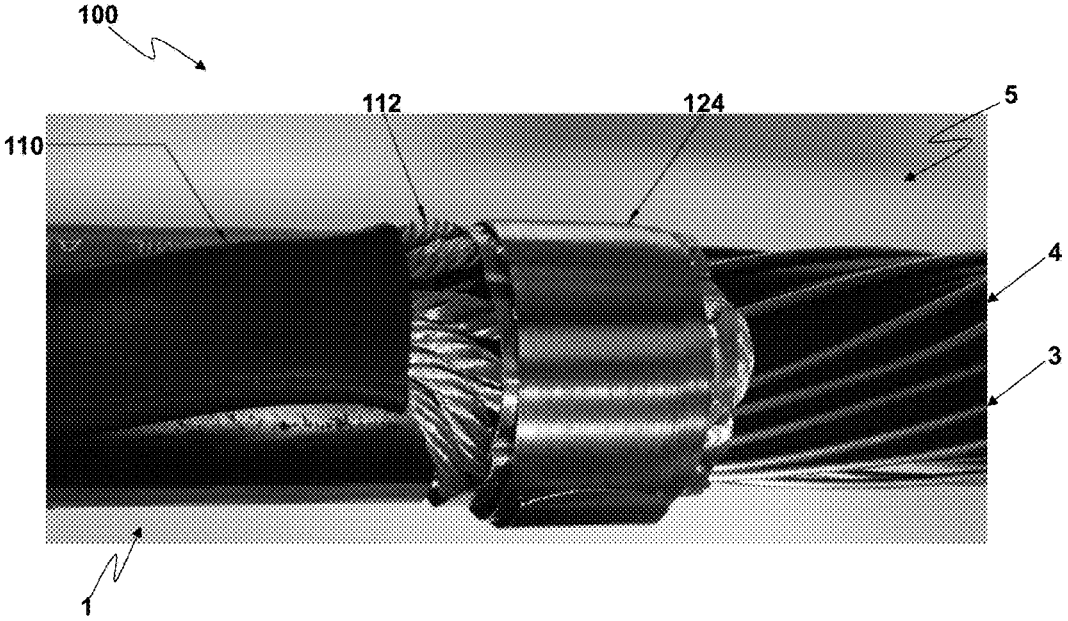
FIG. 4 shows the connector of FIG. 1 fully installed on an electrical cable.

FIGS. 2-4 illustrate a method for reconstructing or restoring a metallic shield 3 of an electrical cable 1 using connector 100. Cable 1 includes an environmental jacket 2. Metallic shield 3 is disposed under jacket 2 and surrounds semiconductive layer 4. A conductor, not shown, is disposed within insulation under semiconductive layer 4 and is used to carry electrical current in, for example, an electrical distribution system. Jacket 2 is removed from a splice region 5, exposing metallic shield 3. For purposes of illustration, splice region 5 is shown wider than is usually employed in actual practice and, in preferred embodiments, would be about the same width as contact strip 122 or only slightly wider.

First, as shown in FIG. 2, contact strip 122 is wrapped around the circumference of metallic shield 3 within splice region 5, such that the internal or bottom face of contact strip 122 directly contacts metallic shield 3, thereby electrically connecting metallic shield 3 to extended connecting member 110. Contact strip 122 preferably extends around the entirety of the circumference of metallic shield 3 and may slightly overlap itself, as previously noted.

Then, as shown in FIG. 3, clamping device 124 is applied to contact strip 122 to hold or bias contact strip 122 into position within splice region 5 against metallic shield 3. For example, with the specific embodiment connector 100, which uses a constant force spring as clamping device 124, the constant force spring 124 is wound around the external or top surface of contact strip 122, thus firmly biasing the internal or bottom surface of contact strip 122 against metallic shield 3. Having an end of the spring 124 firmly, mechanically connected to an end of contact strip 122, such as by bolting, welding, soldering, riveting or the like, can facilitate this process. Of course, clamping device 124 can also be provided as a separate element that is applied once contact strip 122 is in position within splice region 5.

As shown in FIG. 4, once connector 100 is coupled to cable 1 in splice region 5, extended connecting member 110 can then be used to electrically connect metallic shield 3 of electrical cable 1 to another electrical element, such as the metal shield of another electrical cable by way of another neutral connection portion 120, or to a ground terminal by way of a universal connection port. For example, in some configurations where only two cables are being joined, another neutral connection portion 120 on the other end of extended connecting member 110 may be sufficient to electrically connect the metallic shielding of the cables together. In configurations where more than two cables are to be connected, or where one cable is being terminated (such as on a 600 Amp T-Body or a live-front termination), or if a separate ground connection is desired, then it may be advantageous to provide a universal connection port on the other end of extended connecting member 110. Use of another neutral connection portion 120 may be more cost effective, whereas use of a universal connection port may be able to accommodate more configurations.

Because the electrical connection to metallic shield 3 of cable 1 is greatly enhanced by the use of contact strip 122, the design ratings of cable 1 are easier to be met including when cable 1 is operated at its designed steady-state current/temperature ratings for its full life, since the flat design of contact strip 122 prevents clamping device 124 from embedding connecting device 100 into the underlying polymeric layers of cable 1, such as semiconductive layer 4 or the underlying insulation layer.

Furthermore, flat contact strip 122 greatly reduces the assembly complexity of connector 100, as it is relatively easy to wrap around metallic shield 3 of cable 1. In addition, by having, for example, a constant force spring as clamping device 124, which is directly and firmly attached to contact strip 122, ease of application is facilitated.

The problem of inconsistent field assembly is also addressed, as integrating the design of contact strip 122 with clamping device 124 greatly improves assembly consistency.

Various embodiments of the invention also address the issues relating to inconsistent contact resistance between the cable metallic shield and the connecting device, as well as issues relating to changing contact resistance between the cable metallic shield and the connecting device as the cable heats and cools, since the flat contact strip 122 provides a constant contact resistance while providing a broad connection surface, as well as spreading the force of the clamping device 124 over a consistent area. The broad area of contact strip 122 also helps to reduce deformation of the cable polymeric layers, such as semiconductive layer 4.

Figure 5:
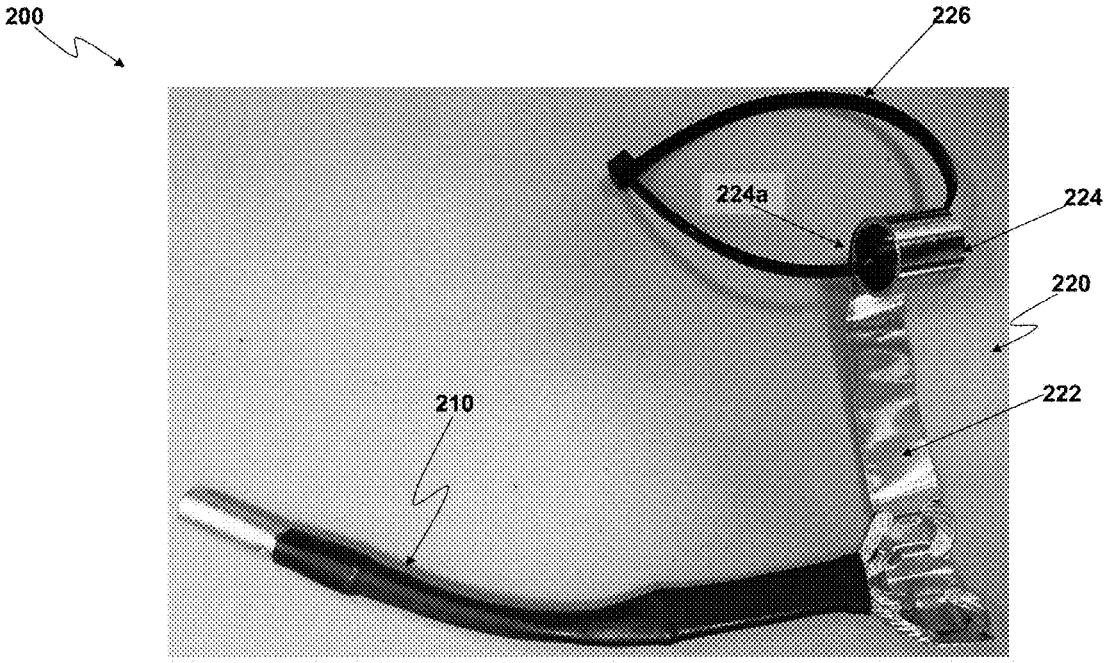
FIG. 5 illustrates another embodiment connector.

A particularly advantageous aspect of certain embodiments of the invention is the use of a loop disposed through the constant force spring to assist in the deployment of the spring. Embodiments that include a constant force spring may therefore employ this aspect to facilitate the unrolling of the constant force spring around the neutral connecting portion. For example, FIG. 5 shows a connector 200 that includes an extended connecting member 210 and a neutral connection portion 220, similar to the connector 100 of FIG. 1. Neutral connection portion 220 includes an electrically-conductive contact strip 222 and a clamping device 224 that is preferably attached (such as riveted or the like) to contact strip 222. Clamping device 224 is in the form of a constant force spring. To facilitate the unrolling of constant force spring 224, a loop 226 of any suitable material, such as plastic, metal or the like, may be passed through the axial opening of constant force spring 224. Loop 226 is preferably sized, configured or both to have a diameter sufficiently large that it may be conveniently grasped and pulled by a person to guide and wind constant force spring 224 around contact strip 222 in the cable splice region. Hence, it will be appreciated that loop 226 may have any suitable shape, such as circular, U-shaped or even additional features, such as an attached handle or the like, to facilitate gripping by the user.

Use of loop 226 for deployment of constant force spring 224 is of great benefit to a worker, since high spring forces inherent in such constant force springs can otherwise make their deployment both difficult and dangerous. For example, constant force springs may be relatively difficult to get started around the target region, such as around contact strip 222, as they are quite thin. This can make deployment extremely challenging when wearing gloves. Alternatively, if a constant force spring 224 is deployed with bare hands and adequate care is not exercised for at least the first one or two wraps, the constant force spring 224 may have a tendency to try to return to its original coiled position. If this happens, the user may be injured as the spring 224 snaps off. In addition, it is potentially quite easy for the user to be cut by the relatively thin material of the spring 224, particularly if the spring 224 has a burr on an edge. Use of loop 226 can alleviate all of these issues and thus greatly simplify deployment of constant force spring 224.

When deploying connecting device 200, the user first wraps contact strip 222 around the metallic shield exposed within the splice region of the cable. Thereafter, the user grasps loop 226 to facilitate the further wrapping of constant force spring 224 around deployed contact strip 222. It will be appreciated that in embodiments in which an end 224*a* of constant force spring 224 is not mechanically connected to contact strip 222, the user may hold a free end of constant force spring 224 into place over and on contact strip 222 with one hand, and then use the other hand to grasp loop 226 to continue the deployment of constant force spring 224 around the splice region. It will therefore be appreciated that in certain aspects, various embodiments employ a method for deploying a constant force spring, such as constant force spring 224, around a device, such as an electrical cable, by deploying (such as by fixing, holding, etc.) an end of the constant force spring on the device (such as end 224*a*), engaging a loop (such as by grasping loop 226) passing through the axial opening of the constant force spring, and using the loop to pull on the constant force spring so as to wind the remainder of the constant force spring around the device. This winding process using the loop may be continued until, for example, the opposite end of the constant force spring is reached, thus finishing the deployment of the constant force spring around the device, such as around an electrical cable.

Figure 6A:
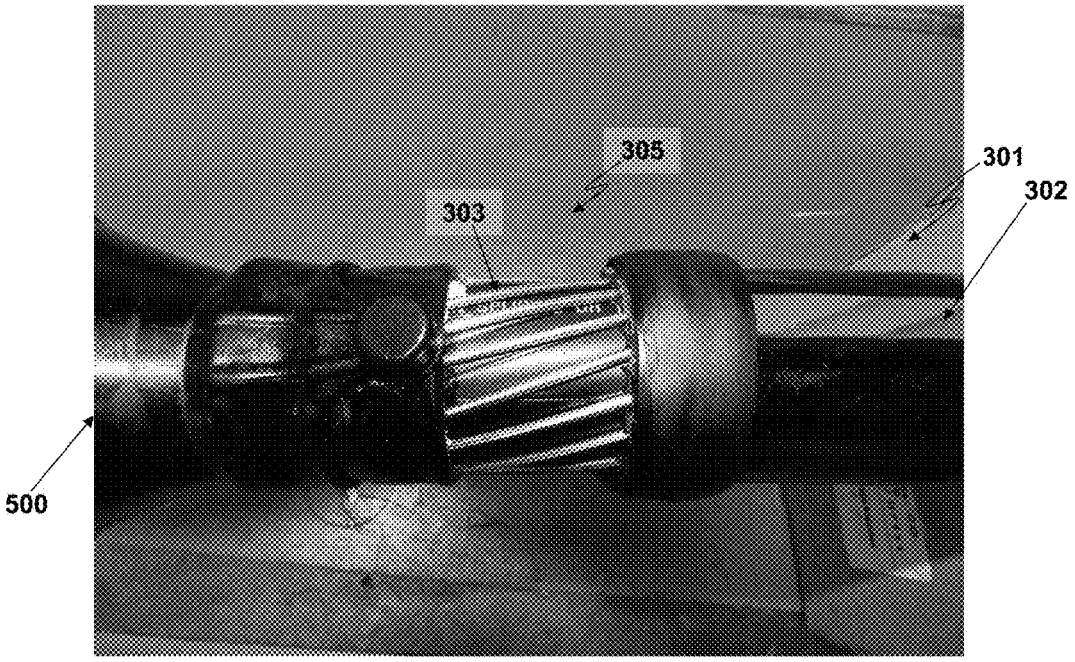
FIGS. 6A-6H illustrate electrically connecting a metallic shield of a cable to another cable metallic shield according to an embodiment of the invention.
Figure 6B:
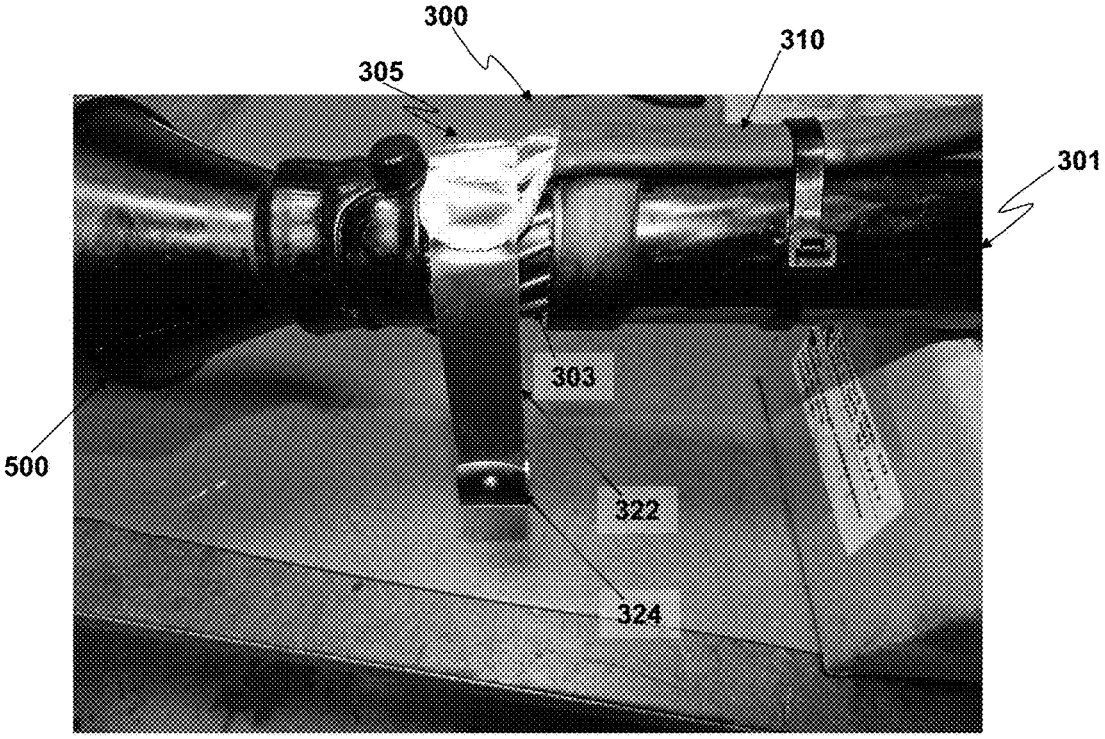
Figure 6C:
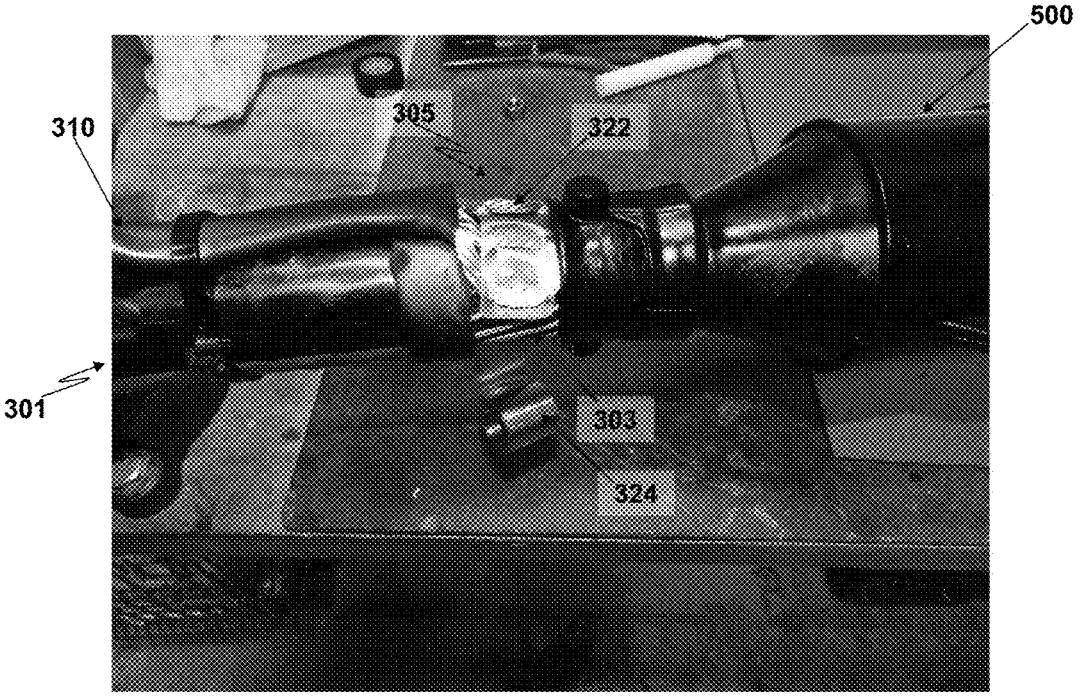
Figure 6D:
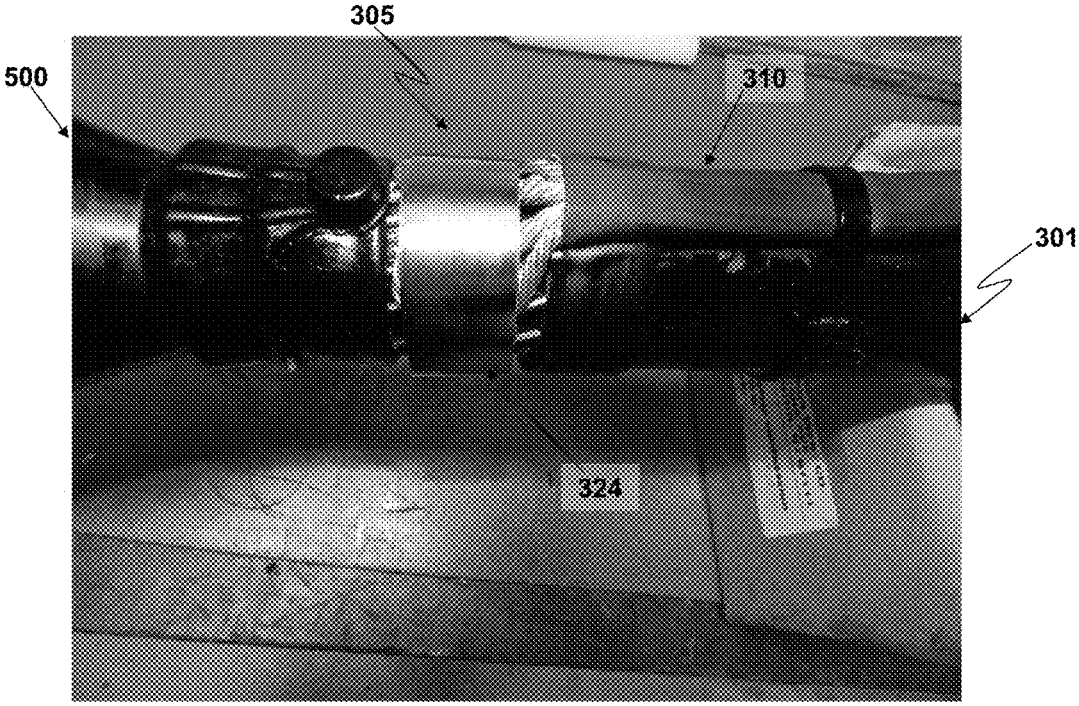
Figure 6E:
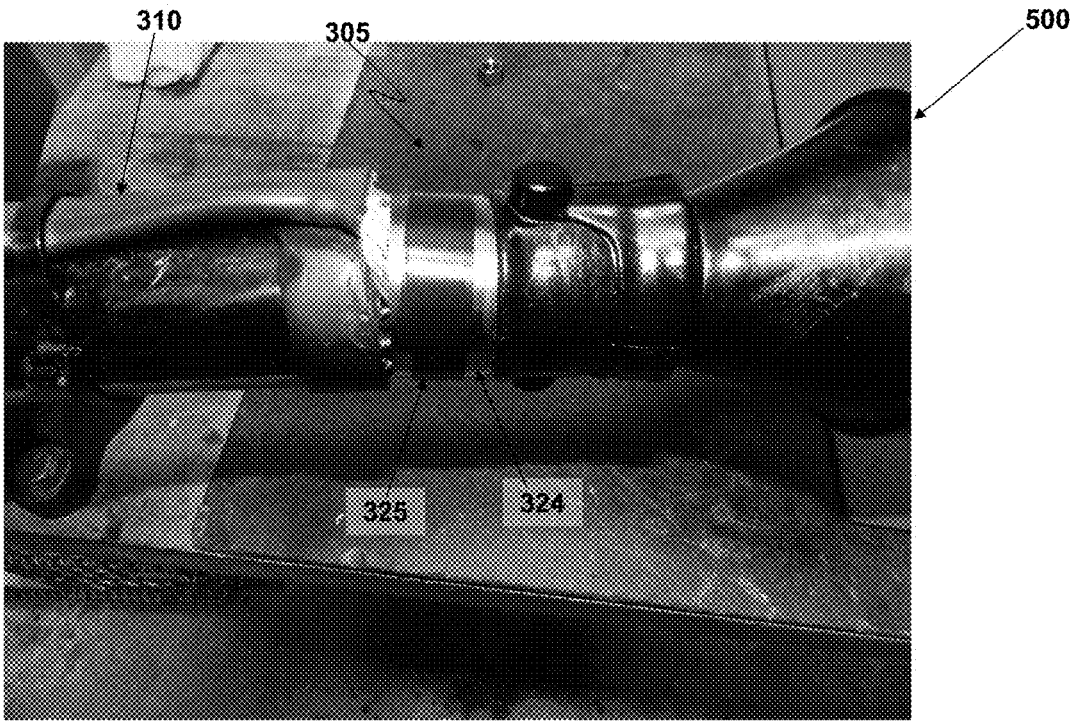
Figure 6F:
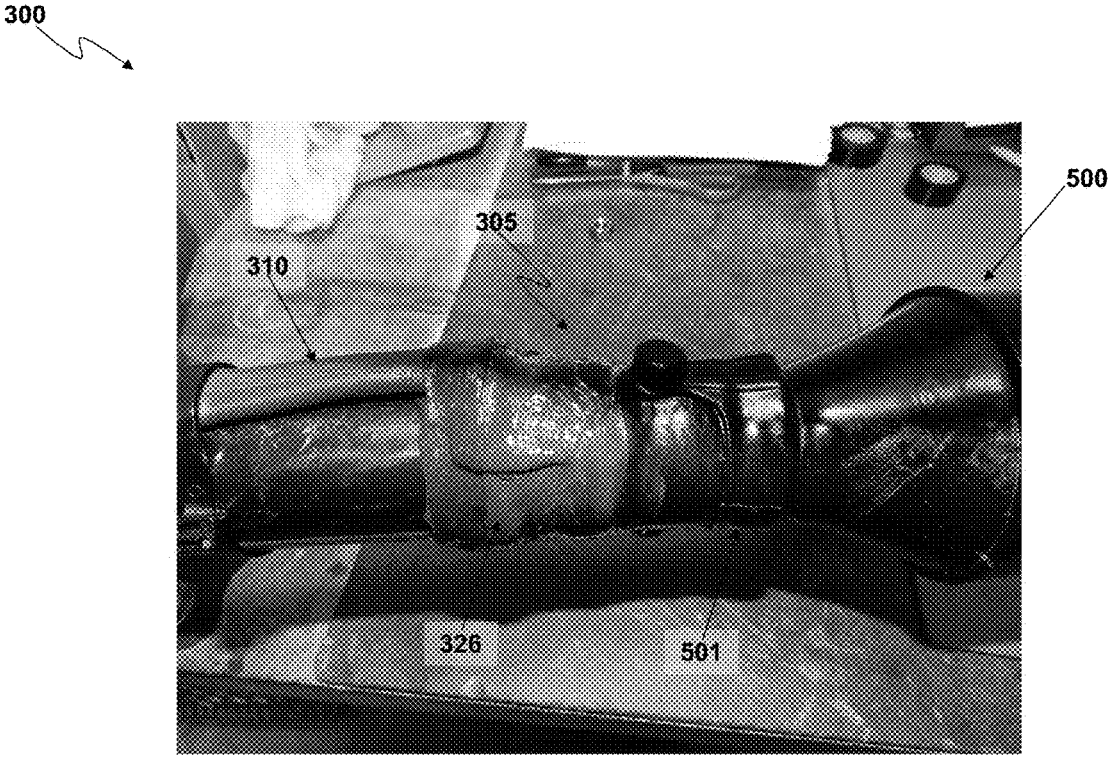
Figure 6G:
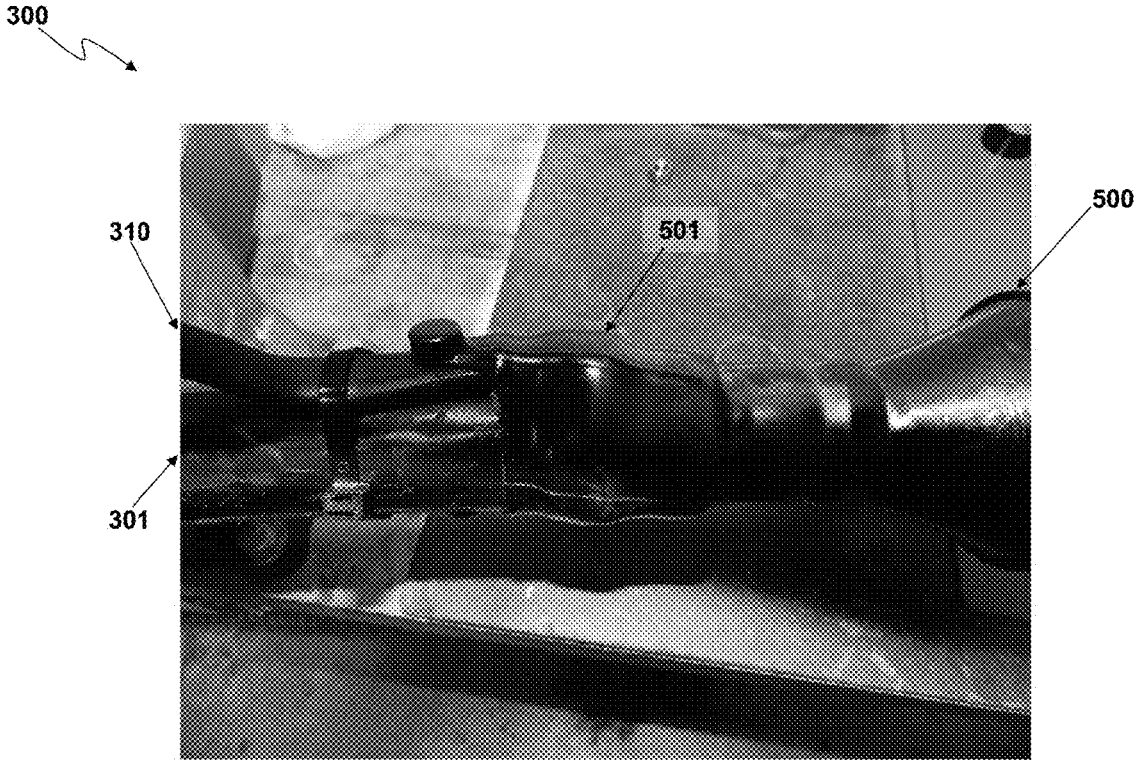
Figure 6H:
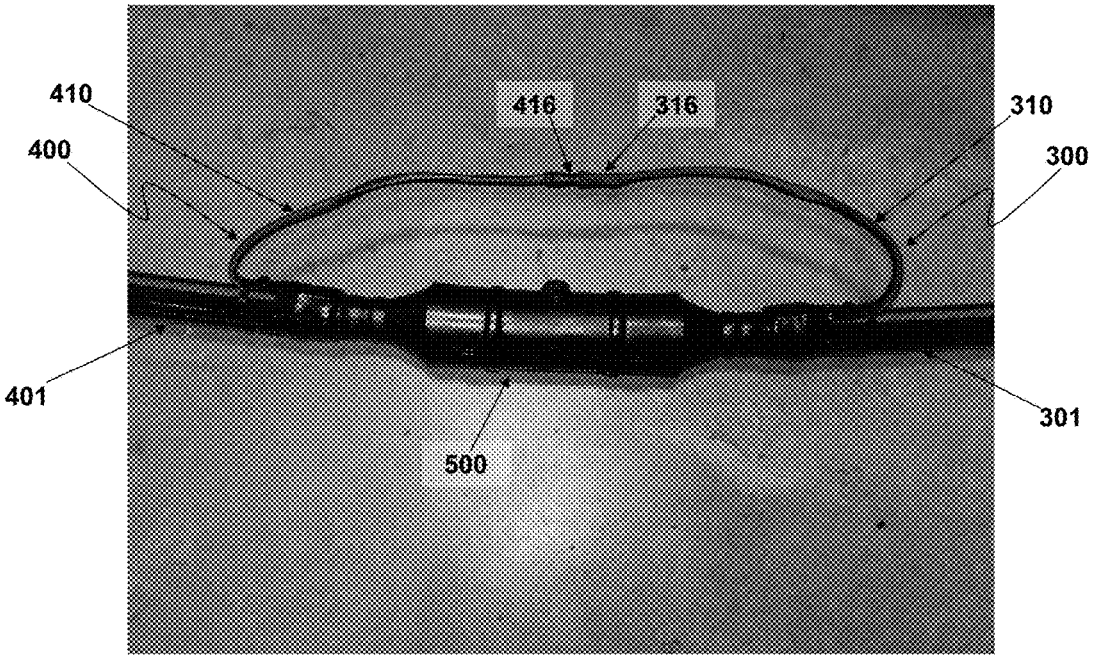

With reference to FIGS. 6A-6H, a method according to an embodiment of the invention is illustrated, in which a metallic shield of a first cable is electrically connected to a metallic shield of a second cable. As shown in FIG. 6H, embodiment connectors 300, 400 are used to electrically connect the metallic shield in a first cable 301 with the metallic shield of second cable 401. Cables 301, 401 are spliced together using any suitable splicing mechanism 500 known in the art, such as the splice and related joint disclosed in U.S. Pat. No. 9,059,581, the contents of which are incorporated herein by reference. Connectors 300, 400 are similar to embodiment connector 100 discussed above, but their respective extended connecting members 310, 410 are electrically connected to each other by any suitable means, such as the mating universal joints 316, 416, clamping, soldering or the like.

The following discussion is in relation to first connector 300 and first cable 301. It will be appreciated that a similar set of steps are performed with respect to second connector 400 and second cable 401. With reference to FIGS. 6A and 6B, a splice region 305 is created in cable jacket 302 of first cable 301 to expose metallic shield 303; splice region 305 is made slightly wider than contact strip 322 of connector 300. As shown in FIGS. 6B and 6C, contact strip 322 is wrapped around the circumference of metallic shield 303 within splice region 305, such that the internal or bottom face of contact strip 322 directly contacts metallic shield 303. A tie-wrap or similar device may be used to anchor extended connecting member 310 to cable 301.

Then, as shown in FIGS. 6D and 6E, clamping device 324, which is in the form of a constant-force spring in this embodiment, is wrapped around contact strip 322 to hold and bias contact strip 322 into position within splice region 305 against metallic shield 303. In an optional step, tape 325 may be wrapped around installed clamping device 324 to further secure clamping device 324 in place within splice region 305.

As shown in FIGS. 6F and 6G, mastic 326 may be applied to joint region 305, covering contact strip 322 and clamping device 324, and then a seal flap 501 of splicing mechanism 500 is pulled over joint region 305 to form a water-tight seal. As a similar series of steps are performed with respect to second cable 401, as shown in FIG. 6H, the respective ends 316, 416 of connectors 300, 400 are coupled together to electrically connect connecting members 310, 410 with each other, and thus electrically connect metallic shield 303 of first cable 301 with the metallic shield in second cable 401.

It will be appreciated that variations to the methods and related systems discussed above are possible. For example, in one variation, the electrically-conductive members of the extended connecting member need not necessarily be initially mechanically connected to the contact strip. In such a possible variation, the contact strip, preferably with the clamping device already attached to it, such as a constant force spring, can be wound over the exposed cable metallic shield within the splice region. Then, prior to deploying the clamping device, the electrically-conductive members of the extended connecting member can be wrapped or laid over or on top of the contact strip. Thereafter, the clamping device, such as the constant force spring, can be deployed over the deployed electrically-conductive members to clamp the electrically-conductive members and the contact strip into place within the splice region over the cable metallic shield.

Or, in another variation, the cable metallic shielding within the splice region may be folded back to fully expose the underlying cable material, e.g., the semiconductive shield layer of the cable. The contact strip, preferably with the clamping device, such as a constant force spring, already attached to it, is then wound over the exposed cable material, e.g., over the cable semiconductive shield material. The cable metallic shield can then be bent back into position within the splice region, but over the now-deployed contact strip. Prior to deploying the clamping device, the electrically-conductive members of the extended connecting member can be wrapped or laid over or on top of the cable metallic shield. Then, the clamping device, such as the constant force spring, can be deployed over the electrically-conductive members to clamp the electrically-conductive members, the cable metallic shield and the contact strip into place within the splice region over the semiconductive shield layer of the cable.

Those skilled in the art will recognize that the present invention has many applications, may be implemented in various manners and, as such is not to be limited by the foregoing embodiments and examples. Any number of the features of the different embodiments described herein may be combined into a single embodiment, the locations of particular elements can be altered and alternate embodiments having fewer than or more than all of the features herein described are possible. Functionality may also be, in whole or in part, distributed among multiple components, in manners now known or to become known.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention. While there has been shown and described fundamental features of the invention as applied to being exemplary embodiments thereof, it will be understood that omissions and substitutions and changes in the form and details of the disclosed invention may be made by those skilled in the art without departing from the spirit of the invention. For example, it will also be appreciated that an advantage offered by specific embodiments of the present invention includes the use of a clamping device, such as a constant force spring, that is mechanically attached to the contact strip, which can greatly simplify deployment of the clamping device. However, this feature is not necessarily required of all embodiments. Moreover, the scope of the present invention covers conventionally known, future developed variations and modifications to the components described herein as would be understood by those skilled in the art.

What is claimed is:

1. A device for electrically connecting a metallic shield of a cable to another electrical element, the device comprising:

a neutral connection portion for electrically connecting to a metallic shield of a cable; and an extended connecting member having a first end electrically connected to the neutral connection portion and a second end configured to connect to another electrical element;

wherein the neutral connection portion comprises a flexible, electrically-conductive substantially flat contact strip, and wherein the extended connecting member comprises a plurality of multi-stranded electrical members electrically connected to the electrically-conductive substantially flat contact strip and substantially evenly spaced over at least a portion of the contact strip so that there is no overlapping of said members on the contact strip.

2. The device of claim 1, wherein the electrically-conductive substantially flat contact strip is configured to be wrapped around a circumference of the cable.

3. The device of claim 2, wherein the electrically-conductive substantially flat contact strip is configured to be wrapped around a circumference of the metallic shield of the cable or around a cable layer underneath the metallic shield of the cable.

4. The device of claim 2, wherein the electrically-conductive substantially flat contact strip has a length at least as long as the circumference of the cable.

5. The device of claim 1, wherein the plurality of electrical members extend along a top surface of the electrically-conductive substantially flat contact strip, and a bottom surface of the electrically-conductive substantially flat contact strip is configured to directly contact a component of the cable.

6. The device of claim 1, wherein the neutral connection portion further comprises a clamping device for biasing the electrically-conductive substantially flat contact strip against a component of the cable when the contact strip is wrapped around a circumference of the cable.

7. The device of claim 6, wherein the clamping device is a constant force spring.

8. The device of claim 7, wherein the constant force spring is mechanically connected to an end of the electrically-conductive substantially flat contact strip.

9. The device of claim 7, wherein a loop configured for grasping is disposed through an axial opening of the constant force spring.

10. The device of claim 1, wherein the extended connecting member further comprises a cover, the plurality of electrical members extending from the cover.

11. The device of claim 10, wherein the cover is configured to prevent ingress of water into the neutral connection portion.

12. The device of claim 1, wherein the second end of the extended connecting member comprises another neutral connection portion or a universal connection port.

13. The device of claim 12, wherein the universal connection port comprises a connector, a ferrule, a compression connector, a flat spade, a bolted connection, or a "T" tap.

14. The device of claim 1, wherein the electrically-conductive substantially flat contact strip is configured to electrically and physically interface with the metallic shield of the cable through an electrically conductive intermediate material.

15. The device of claim 14, wherein the electrically conductive intermediate material comprises a copper mesh.

16. The device of claim 1, wherein each of the plurality of multi-stranded electrical members comprises multi-strand wire or flexible cable.

17. A method for electrically connecting a metallic shield of a cable to another electrical element, the method comprising:

wrapping a flexible, electrically-conductive substantially flat contact strip around at least a portion of a circumference of an exposed metallic shield of a cable or around at least a portion of a circumference of a layer underneath the exposed metallic shield, wherein the electrically-conductive substantially flat contact strip is electrically connected to a first end of an extended connecting member, wherein the extended connecting member comprises a plurality of multi-stranded electrical members electrically connected to the electrically-conductive substantially flat contact strip and substantially evenly spaced over at least a portion of the contact strip so that there is no overlapping of said members on the contact strip;

coupling a clamping device to the wrapped electrically-conductive contact strip to bias the wrapped electrically-conductive contact strip against the metallic shield; and electrically connecting a second end of the extended connecting member to another electrical element.

18. The method of claim 17, wherein the electrically-conductive substantially flat contact strip has a length at least as long as the circumference of the exposed metallic shield or the circumference of the layer underneath the exposed metallic shield.

19. The method of claim 17, wherein the plurality of electrical members extend along a top surface of the electrically-conductive substantially flat contact strip, and a bottom surface of the electrically-conductive substantially flat contact strip is configured to directly contact the exposed metallic shield or the layer underneath the exposed metallic shield.

20. The method of claim 17, wherein the clamping device is a constant force spring.

21. The method of claim 20, wherein the coupling the clamping device to the wrapped electrically-conductive contact strip comprises winding the constant force spring over the wrapped electrically-conductive contact strip.

22. The method of claim 20, wherein the coupling the clamping device to the wrapped electrically-conductive contact strip comprises:

deploying an end of the constant force spring on or over the wrapped electrically-conductive contact strip; and using a loop disposed through an axial opening of the constant force spring to wind a remainder of the constant force spring around the wrapped electrically-conductive contact strip.

23. The method of claim 17, further comprising:

moving the exposed metallic shield of the cable to expose the layer underneath the exposed metallic shield;

wrapping the electrically-conductive substantially flat contact strip around the layer underneath the exposed metallic shield;

disposing the exposed metallic shield over the wrapped electrically-conductive contact strip; and deploying the clamping device over the exposed metallic shield.

24. The method of claim 17, further comprising:

wrapping the electrically-conductive substantially flat contact strip around the exposed metallic shield; and deploying the clamping device over the wrapped electrically-conductive contact strip.

25. The method of claim 24, further comprising deploying the clamping device over the wrapped electrically-conductive contact strip and the plurality of electrical members of the extended connecting member.

26. A clamping assembly for use with a device for electrically connecting a metallic shield of a cable to another electrical element, the clamping assembly comprising:

a clamping device for biasing an electrically-conductive substantially flat contact strip against a component of the cable when the contact strip is wrapped around a circumference of the cable, wherein the clamping device is mechanically connected to an end of the electrically-conductive substantially flat contact strip, and wherein the clamping device is a constant force spring; and a loop disposed through an axial opening of the constant force spring, wherein the loop is configured for grasping and pulling to guide and wind the constant force spring around the wrapped electrically-conductive contact strip in a cable splice region.

27. The clamping assembly of claim 26, wherein the loop is made of plastic.

28. The clamping assembly of claim 26, wherein the electrically-conductive substantially flat contact strip comprises a copper mesh.

* * * * *